US005178567A

United States Patent [19]

Mondek

[11] Patent Number: 5,178,567

[45] Date of Patent: Jan. 12, 1993

[54] MARINE ENGINE HOUSING COOLING APPARATUS

[75] Inventor: Martin J. Mondek, Wonder Lake, Ill.

[73] Assignee: Outboard Marine Corporation, Waukegan, Ill.

[21] Appl. No.: 834,609

[22] Filed: Feb. 12, 1992

Related U.S. Application Data

[63] Continuation-in-part of Ser. No. 642,051, Jan. 16, 1991, abandoned.

[51] Int. Cl.[5] ..... B63H 21/14

[52] U.S. Cl. ..... 440/88; 123/41.31; 415/176

[58] Field of Search ..... 440/88; 415/175, 176; 123/41.31, 41.47

[56] References Cited

U.S. PATENT DOCUMENTS 2,903,991 9/1959 Carlson et al. ..... 440/88

4,371,351 2/1983 Tousey ..... 440/88

4,565,534 1/1986 Bland ..... 440/88

4,959,033 9/1990 Bland et al. ..... 440/88 X

FOREIGN PATENT DOCUMENTS 55-119992 9/1980 Japan ..... 440/88

*Primary Examiner*—Sherman Basinger

*Attorney, Agent, or Firm*—Welsh & Katz, Ltd.

[57] ABSTRACT

Apparatus for use in cooling a marine engine is disclosed which includes a cylindrically shaped impeller having a plurality of vanes attached thereto, a housing with a main chamber in which the impeller is located, the impeller being driven by a drive shaft of the engine. The housing has a second chamber located between the main chamber and an outer end wall through which water is pumped to cool the separating wall between the chambers, which may be heated by the rotating impeller during operation.

15 Claims, 3 Drawing Sheets

MARINE ENGINE HOUSING COOLING APPARATUS

RELATED APPLICATION

This application is a continuation-in-part of U.S. Ser. No. 07/642,051, filed Jan. 16, 1991 and entitled "MARINE ENGINE HOUSING COOLING APPARATUS", and now abandoned.

BACKGROUND OF THE INVENTION

The present invention generally relates to apparatus for cooling marine engines, and more particularly relates to apparatus for cooling the housing of a water pump assembly that is used on marine propulsion engines.

Those skilled in the art of marine propulsion engines know that many types of such engines utilize the water in which the boat floats as the means for cooling. Also, many of such engines utilize a water pump assembly to force water through the manifolds of the engine for cooling the same. Typically, such water pump assemblies used on such engines have a rubber vaned impeller and a plastic impeller housing. While the use of a plastic impeller housing is advantageous in terms of cost of production, the rotating impeller may contact the inner surface of the housing and cause wear which can significantly reduce the effective useful life of the housing.

Because of the wear that is often experienced because of the contact, it is common and desirable to apply a liner to the inside of the housing, and such a liner is often made of stainless steel which is pressed or clamped in place. The liner provides a wear resistant surface for the housing.

Under normal operating conditions for such an engine, the heat that is generated by friction resulting from the impeller contacting the housing liner is dissipated by the water flowing through the pump. However, improvements in the design and development of marine engines have resulted in higher speeds of operation. With such higher revving engines, or as a result of other conditions such as conditions which create aerated water resulting in impeller cavitation, more heat may be generated than can be effectively transferred by the water that is actually flowing through the pump. If those conditions occur, thermal damage to the housing and impeller can be sustained.

Accordingly, it is a primary object of the present invention to provide an improved water pump assembly which minimizes the potential for thermal damage to a housing and impeller that would otherwise be susceptible to such damage.

Another object of the present invention is to provide such an improved water pump assembly that achieves thermal protection to a housing that is susceptible to thermal damage under certain conditions, and which achieves such protection with a minimum of expense through an efficient and effective design.

Yet another object of the present invention is in the provision of providing such thermal protection by providing a second chamber adjacent the main chamber in which the impeller is located, so that water is circulated through the second chamber for achieving sufficient heat transfer when the heat transfer resulting from water flow through the main chamber is insufficient.

These and other objects will become apparent upon reading the following detailed description of the present invention, while referring to the attached drawings, in which.

DETAILED DESCRIPTION

Figure 3:
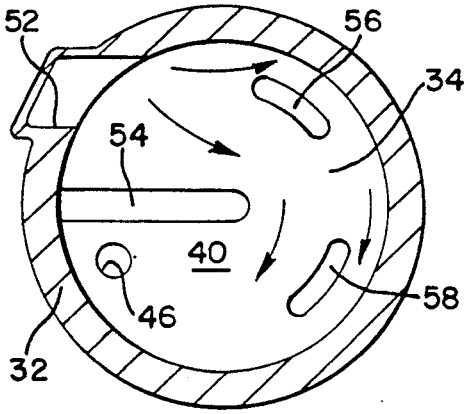
FIG. 3 is a cross sectional view taken generally along the line 3—3 of FIG. 2, particularly illustrating deflecting ribs located in the second chamber of the water pump assembly of the present invention.
Figure 4:
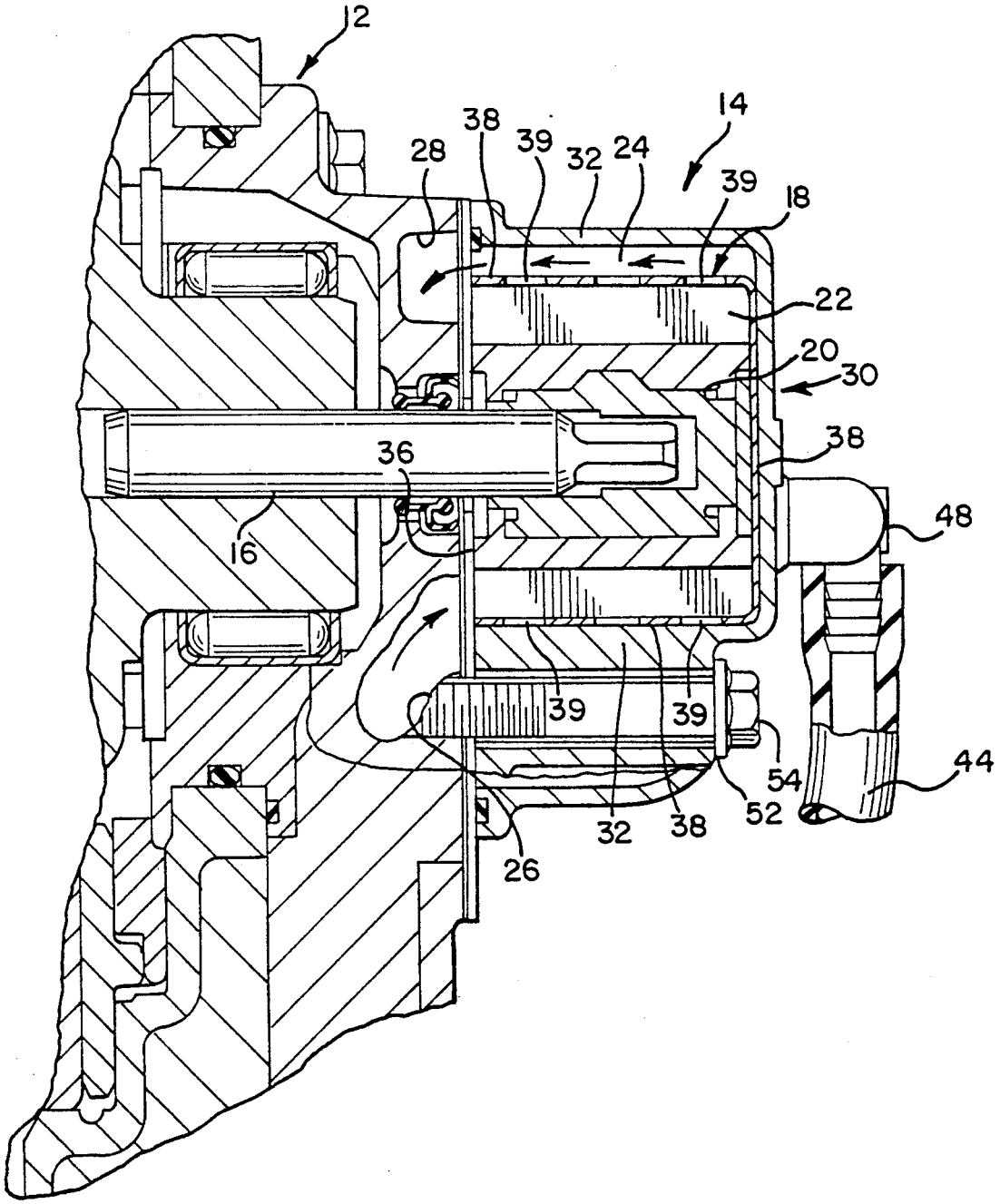
FIG. 4 PRIOR ART
FIG. 4 is a side elevation, partially in section, illustrating a water pump assembly of the prior art installed in a marine engine, of which only a portion is shown.

Broadly stated, the water pump assembly of the present invention, of which a preferred embodiment is illustrated in the drawings of FIGS. 2, 3, 5 and 6, offers superior heat transfer capability over prior art water pump assemblies of which an example is shown in FIG. 4. The water pump assembly of the present invention substantially reduces, if not effectively precludes the potential for thermal damage to the outer housing of the water pump assembly. The potential for thermal damage exists as a result of the desire to produce such housings from a plastic or other materials which are susceptible to thermal damage.

The present invention accomplishes the goal of providing thermal protection by providing a second chamber through which a portion of the flow of water pumped by the water pump assembly is directed, and this chamber is located adjacent the main chamber in which the impeller is located. It is the rotation of the impeller which typically has a number of radially directed rubber vanes, and which often rubs on the housing and generates heat due to friction. While under normal conditions, the water flowing through the main chamber provides sufficient heat transfer to prevent thermal damage to the housing, higher revving engines can exceed the capacity of removing heat, or conditions such as pump cavitation can result in thermal damage to the housing.

The present invention diverts some of the flow from the outlet of the pump assembly and directs that diverted flow into the second chamber which is located on the opposite side of a liner that separates the main and second chambers. Since the heat produced is caused by friction contact of the impeller against this liner, the heat transfer capability of the water flowing through the second chamber substantially reduces the possibility of thermal damage to the housing occurring.

Turning now to the drawings, a side elevation of a prior art is shown in FIG. 4, and while the invention will be described in connection with FIGS. 2, 3, 5, and 6, common reference numbers will be used in connection with all FIGS. when common elements exist in the water pump assembly of the present invention and in the prior art pump assembly.

Figure 1:
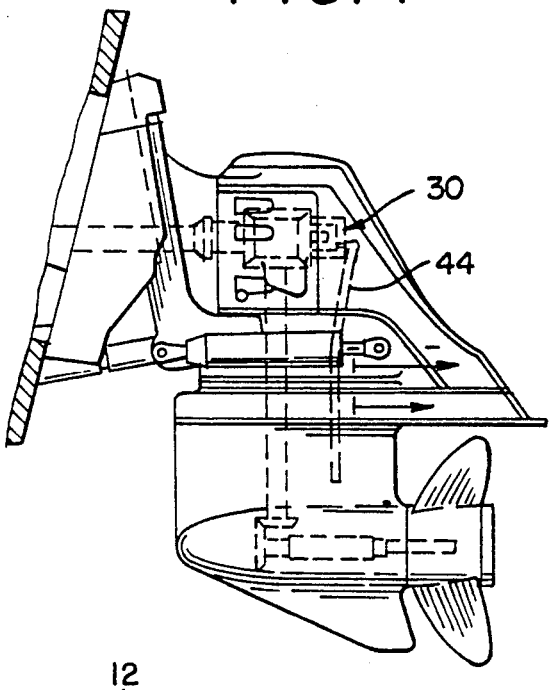
FIG. 1 is a side elevation of a marine engine, with portions shown in phantom, and including portions of the present invention.

The water pump assembly of the present invention is indicated generally at 10, and is shown attached to a marine engine, indicated generally at 12. The water pump assembly of the prior art shown in FIG. 4 is indicated generally at 14. While not illustrated in FIG. 1, a drive shaft 16 associated with the engine 12 and illustrated in FIGS. 2 and 4, drives the water pump assembly 10 (as well as the pump assembly 14).

The water pump assembly 10 has an impeller, indicated generally at 18, which includes a cylindrical hub 20, to which a plurality of radially extending vanes 22 are attached. The hub 20 has an internal aperture with cooperative configuration to retain splines or the like that are formed in the end of the shaft 16, so that the hub is positively driven by rotation of the shaft 16. There are preferably 10 to 12 of such vanes, but a greater or lesser number may be present, as desired for optimizing the efficiency of the pumping capability, and considering the speed of operation of the engine and the water pump assembly.

Figure 2:
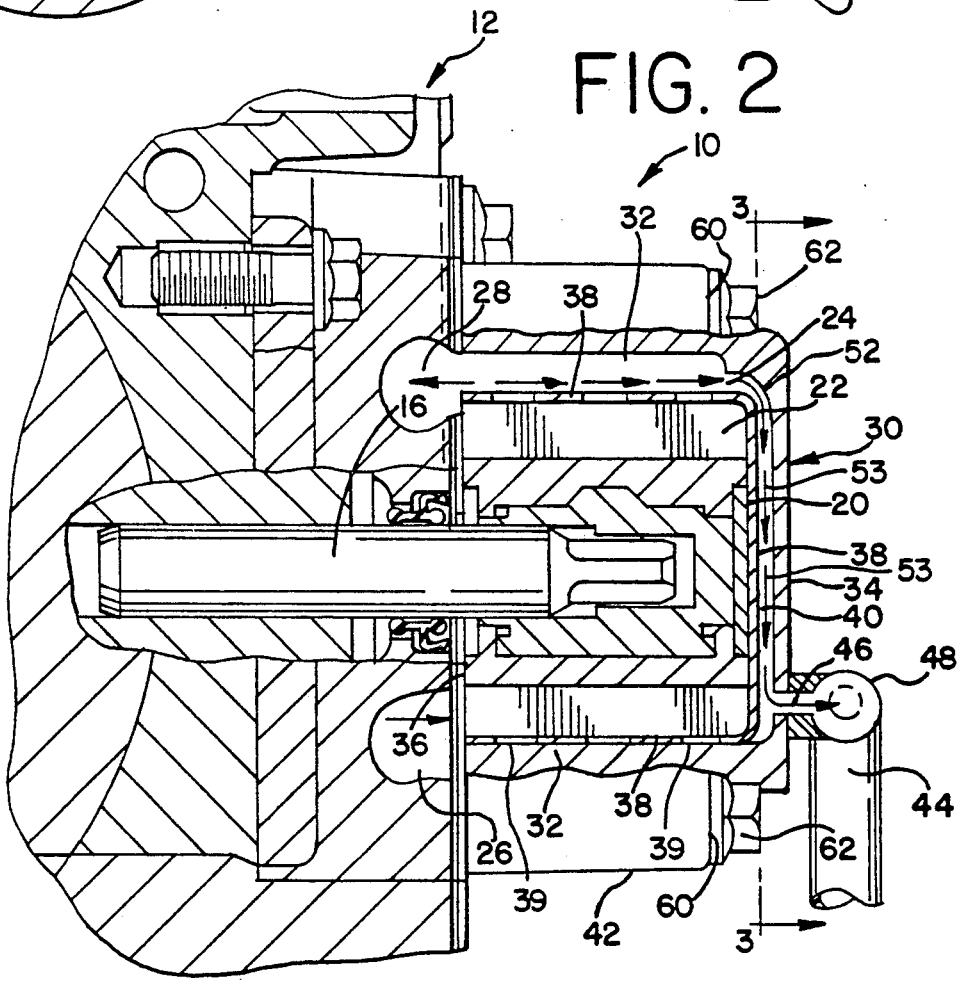
FIG. 2 is a side elevation of an embodiment of a water pump assembly of the present invention, partially in section taken along the line 2—2 of FIG. 5 and in the direction indicated generally, installed on a marine engine, of which only a portion is illustrated.

The vanes 22 are preferably fabricated from rubber and are generally rectangular in shape. Outer edges of each of the vanes 22 are preferably provided with thickened rib formations 23 (best seen in FIG. 6) to enhance the movement of water through a main chamber 24. The impeller is located in the main chamber 24 which has water admitted through an inlet 26 located near the bottom of the chamber as shown in FIG. 2, and the water is expelled by the rotating impeller through an outlet 28 that is located near the top of the chamber 24. The inlet 26 and outlet 28 communicate with corresponding inlet and outlet manifolds in the engine, and these manifolds do not comprise a part of the present invention.

Figure 5:
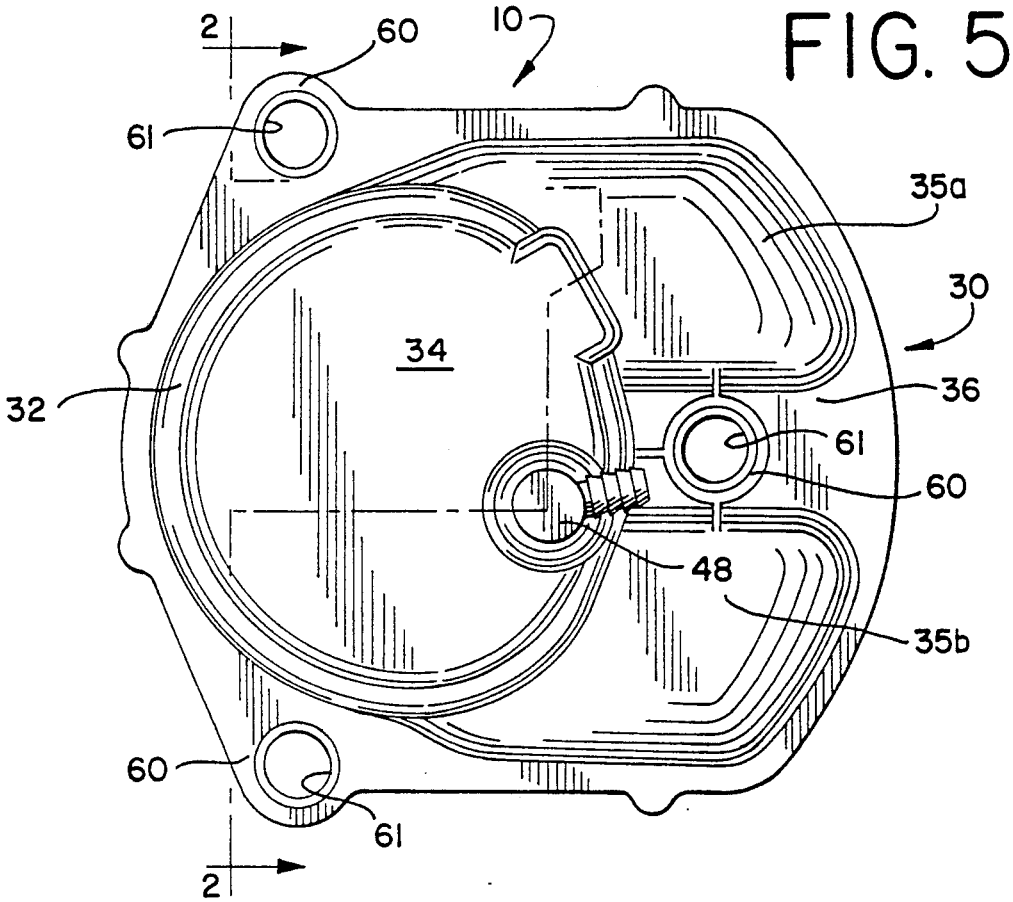
FIG. 5 is a front elevational view of the water pump assembly of the present invention.

The water pump assembly 10 includes a housing, indicated generally at 30, which has a generally U-shaped configuration (best seen in FIGS. 5 and 6), including a cylindrical in cross-section side wall 32 and an outer end wall 34 that is generally circular as shown in FIGS. 3 and 5. Also included in the housing 30 are upper and lower lobe portions, 35*a*, 35*b*, respectively, which are in fluid communication with the portion of the main chamber 24 enclosing the impeller 20. A generally horizontally oriented baffle member 36 separates the upper and lower lobe portions 35*a*, 35*b* and prevents water from moving from one portion to the other except through the area of the main chamber 24 occupied by the impeller 20.

Since the vanes 22 of the impeller 20 may contact the housing 30, a wear resistant liner 38 is preferably provided inside said housing 30, and the liner 38 is preferably fabricated from stainless steel, although another suitable wear resistant material may be used. The liner 38 is preferably coextensive with a substantial portion of the inside surface of the side wall 32 and has a rightward end wall. Furthermore, the liner 38 is provided with a plurality of generally parallel, spaced, peripheral slots 39 (best seen in FIG. 2). The slots 39 are the openings through which water is drawn, from the inlet 26 and the lower lobe portion 35*b*, and into the outlet 28 and the upper lobe 35*a*, by the impeller 20. The liner 38 is preferably of unitary construction.

As is shown in the drawings, the liner 38 is concentric with the impeller 20, and the upper lobe portion 35*a* is configured so that a space is provided between the liner and the inside surface of the upper portion of the housing side wall 32 to provide a passageway for water from the outlet 28 to a second chamber 40. With the housing 30, the outer surface of the engine therefore defines the main chamber 24 and the second chamber 40, with the second chamber being specifically defined by a portion of the side wall 32, the liner 38 and the outer end wall 34. Although the second chamber 40 is substantially smaller than the main chamber 24, and preferably has a volume capacity of only about one tenth of the main chamber 24, other relative sizes of the chambers 24 and 40 are contemplated.

Figure 6:
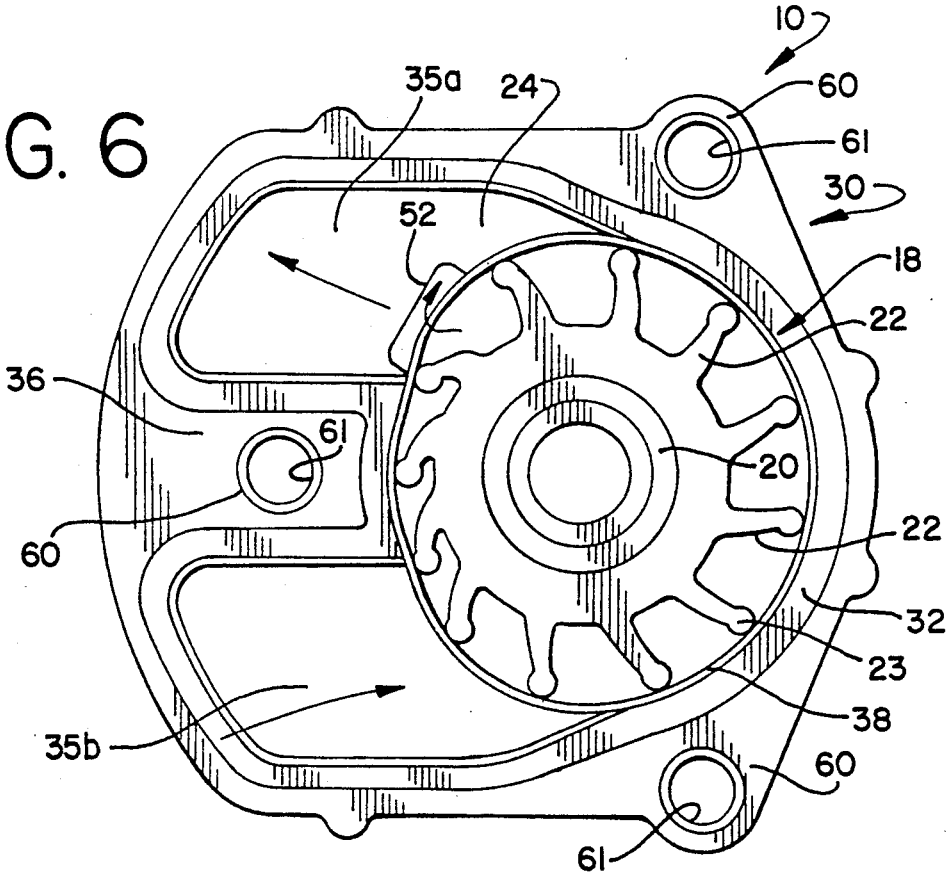
FIG. 6 is a rear elevational view of the water pump assembly shown in FIG. 5.

It is evident from FIG. 6 that there is a relatively tight fit between the vanes 2 of the impeller 20 and the liner 38. Also, as previously mentioned, while the heat transfer characteristics of the water being pumped during normal operation are sufficient to minimize the possibility of thermal damage, if the water pump assembly experiences cavitation or if the motor and pump are operated at extremely high speeds, the vanes 22 may contact the liner 38 and create friction and therefore excessive heat that can cause thermal damage to the plastic housing.

Another cause of enhanced friction is due to a modification of the pump assembly 10 in which an increase of the eccentricity of the impeller 20 relative to the center of the housing 30 may be made to increase the flow rate of the pump. Such a modification to the standard pump assembly 10 increases pressure of the rib formations 23 against the liner 38, and also results in more work being performed by the pump. Both of these factors increase friction and heat generation.

In accordance with an important aspect of the present invention, some of the water being pumped is diverted from the outlet 28 and is pumped from the upper lobe portion 35*a* through the second chamber 40 to a purge conduit, indicated generally at 44, which is connected to a port 46 by connector fitting 48. This diverted water is then routed to cool the propeller hub (not shown). The water passages in the marine propulsion device may also have a drain plug (not shown) which allows for draining the water in the device, such as in winter, to prevent freezing.

The flow of water through the second chamber 40 provides additional heat transfer capability and keeps the outer end wall 34 sufficiently cool so that thermal damage does not deform the outer end wall 34 which could result in failure of the water pump assembly.

Referring to FIGS. 2, 3, and 6, the water is admitted to the chamber 40 by an inlet 52 located near the top of the chamber 24 and at the top of the chamber 40, and water moves from the inlet 52 to the port 46 through the chamber 40, as indicated by the arrows 53 shown in FIG. 2. It is preferred that the inlet 52 be dimensioned so that only a small amount of water exiting the impeller 20 is diverted into the second chamber 40. To direct the flow so that more uniform cooling of the entire surface of the outer end wall 38 occurs, a number of ribs 54, 56 and 58 are provided. While the number and shape of the ribs may vary, it is preferred that the rib 54 extend from the side wall 32 to approximately the center of the second chamber 40, and the ribs 56 and 58 may be short curved segments as shown. The ribs also provide stop surfaces and also support for the liner structure 38 when it is pressed into the housing 30.

The housing 30 contains suitable bosses 60 with apertures 61 through which bolts 62 may be inserted and secured in threaded openings of the engine (not shown) for attaching the water pump assembly to the engine. Suitable gaskets may be provided at the interface between the engine and the adjoining surfaces of the housing 30.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for use in cooling a marine engine, wherein the apparatus is driven by the engine, said apparatus comprising:

a rotatable impeller having a hub means to which a plurality of radially outwardly extending vanes are attached, a first end of said impeller being operatively connected to the marine engine by said hub means whereby said impeller rotates when the engine is operating, said impeller having a generally cylindrical shape and being capable of moving water when rotated;

an impeller housing generally surrounding said impeller, said housing having a generally cylindrical side wall and an outer end wall;

liner means for providing a wear resistant surface adapted to be contacted by said impeller, said liner means having a cylindrical side wall substantially coextensive with said side wall of said housing and having a closed end adjacent said outer end wall of said housing, the inside of said liner means defining a portion of a main chamber in which said impeller is located;

inlet means communicating said main chamber a supply of water when said marine engine is placed in water for operation and adapted to admit water into said main chamber;

outlet means communicating with aid main chamber and adapted to expel water from said main chamber;

rotation of said impeller applying a suction force for moving water into said main chamber from said inlet means and out of said main chamber through said outlet means;

said impeller housing and said liner means defining a second chamber located between a portion of said liner means and said outer end wall, said housing including a space communicating said second chamber with said main chamber whereby water is admitted into sad second chamber when said impeller is rotated;

said housing including at least a first flow directing rib located on the inside surface of the outer end wall of said housing for directing flow of water through said second chamber in a manner whereby water flow is directed across a substantial portion of the surface area of said outer end wall so that heat transfer is increased relative to that achieved in the event water flowed directly from said space to purge conduit means; and, said purge conduit means being attached to said housing and being adapted to expel water from said second chamber;

rotation of said ,impeller causing water to flow through said second chamber to said purge conduit means for cooling said impeller housing outer end wall.

2. Apparatus as defined in claim 1 wherein the outside diameter of said liner means is smaller than the inside diameter of said housing side wall, said liner means being positioned inside said housing whereby said space is provided therebetween adjacent said outlet means, such that water from said outlet means can flow into said second chamber through said space.

3. Apparatus as defined in claim 2 wherein said liner means comprises a wear resistant material and said liner means is held by predetermined inside surfaces of said housing.

4. Apparatus as defined in claim 3 wherein said wear resistant material is stainless steel

5. Apparatus as defined in claim 1 wherein said housing is comprised of plastic.

6. Apparatus as defined in claim 1 wherein said main chamber has an upper lobe portion and a lower lobe portion, and said outlet means is located near the upper lobe portion of said main chamber, said inlet means is located in the lower lobe portion of said main chamber and said space is located between an upper end of the upper lobe portion of said impeller housing sidewall and said liner means.

7. Apparatus as defined in claim 1 wherein the cross section of said second taken along a plane parallel to said outer end is circular, said first rib extending from the inside surface of said side wall of said impeller housing and extending approximately midway across said second chamber, said first rib being positioned between said space and said purge conduit means.

8. Apparatus as defined in claim 1 further including a pair of smaller ribs located within said second chamber and being positioned generally between the end of said first rib and said side wall of said impeller housing.

9. Apparatus as defined in claim 1 wherein said main chamber has a volume approximately 10 times larger than the volume of said second chamber.

10. Apparatus as defined in claim 1 wherein said hub means of said impelled comprises a generally cylindrically shaped member adapted to have said vanes attached thereto in spaced relation relative to one another, said member including an aperture for receiving a complementary shaped elongated engine shaft for rotating said impeller.

11. Apparatus as defined in claim 1 wherein said outer end wall includes an aperture for receiving said purge conduit means, said purge conduit means comprising a connection for said aperture and a flexible conduit that extends from said correction to the supply of water that is in communication with said inlet means.

12. Apparatus for use in cooling a marine engine, wherein the apparatus is driven by the engine, said apparatus comprising:

a rotatable impeller having a hub means to which a plurality of radially outwardly extending vanes are attached, a first end of said impelled being operatively connected to a drive shaft of the marine engine by said hub means whereby said impeller rotates when the engine drive shaft is rotated during operation of the engine, said impeller having a generally cylindrical shape and being capable of pumping water when rotated;

an impeller housing generally surrounding said impeller, said housing having a generally cylindrical side wall and an outer end wall;

liner means for providing a wear resistant surface adapted to be contacted by said impeller, said liner means having a cylindrical side wall substantially coextensive with said side wall of said housing and having a closed end adjacent said outer end wall of said housing, the inside of said liner means defining a main chamber in which said impeller is located;

inlet means communicating said main chamber with a supply of water when said marine engine is placed in water for operation and adapted to admit water into said main chamber;

outlet means communicating with said main chamber and adapted to expel water from said main chamber;

rotation of said impeller applying a suction force for moving water into said main chamber from said inlet means and out of said main chamber through said outlet means;

said impeller housing and said liner means defining a second chamber located between a portion of said liner means and said outer end wall, said housing including a space communicating said second chamber with said main chamber whereby water is admitted into said second chamber when said impeller is rotated;

said housing including at last a first flow directing rib located on the inside surface of the outer end wall of said housing for directing flow of water through said second chamber in a manner whereby water flow is directed across a substantial portion of the inner surface area of said outer end wall so that heat transfer is increased relative to that achieved in the event water flowed directly from said space to purge conduit means; and, said purge conduit means being attached to said housing and being adapted to expel water from said second chamber.

13. Apparatus as defined in claim 12 wherein said second chamber is located between said liner means and said outer end wall of said housing.

14. Apparatus as defined in claim 12 wherein the cross section of said second chamber taken along a plane parallel to said outer end wall is circular, said first rib extending from the inside surface of said side wall of said impeller housing and extending approximately midway across said second chamber, said first rib being positioned between said space and said purge conduit means.

15. Apparatus as defined in claim 14 further including at least a pair of smaller ribs located within said second chamber and being positioned generally between the end of said first rib and said side wall of said impeller housing.

* * * * *

UNITED STATES PATENT AND TRADEMARK OFFICE

CERTIFICATE OF CORRECTION

PATENT NO. : 5,178,567

DATED : January 12, 1993

INVENTOR(S) : Martin J. Mondek

It is certified that error appears in the above-identified patent and that said Letters Patent is hereby corrected as shown below:

Column 5, line 31, after "chamber" insert --with--;

Column 5, line 35, delete "aid" and insert --said--;

Column 5, line 61, before "impeller" delete the comma;

Column 6, line 9, after "steel" insert a period;

Column 6, line 21, after "second" insert --chamber--;

Column 6, line 35, delete "impelled" and insert --impeller--;

Column 6, line 52, delete "impelled" and insert --impeller--; and

Column 7, line 19, delete "last" and insert --least--.

Signed and Sealed this

Eleventh Day of January, 1994

Bruce Lehman

*Attest:*

BRUCE LEHMAN

*Attesting Officer*

*Commissioner of Patents and Trademarks*